US008166679B2

(12) United States Patent
Lee et al.

(10) Patent No.: US 8,166,679 B2
(45) Date of Patent: May 1, 2012

(54) ELECTRIC IRON

(75) Inventors: Chih-Hwa Lee, Tainan (TW); Chien-Chih Pan, Tainan (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 289 days.

(21) Appl. No.: 12/625,799

(22) Filed: Nov. 25, 2009

(65) Prior Publication Data

US 2010/0126049 A1 May 27, 2010

(30) Foreign Application Priority Data

Nov. 25, 2008 (CN) ..... 2008 2 0229164

(51) Int. Cl.
*D06F 75/18* (2006.01)
*D06F 75/38* (2006.01)

(52) U.S. Cl. ..... 38/77.3; 38/81

(58) Field of Classification Search ..... 38/74–77.83, 38/88, 93, 90–95; 68/222; 392/386, 399, 392/404–406; 219/249
See application file for complete search history.

(56) References Cited

U.S. PATENT DOCUMENTS

| | | | | | |
|---|---|---|---|---|---|
| 1,583,460 | A | * | 5/1926 | Hansson | 38/81 |
| 2,620,576 | A | * | 12/1952 | Stevenson et al. | 38/77.3 |
| 3,413,741 | A | * | 12/1968 | Fagan et al. | 38/77.3 |
| 3,949,499 | A | * | 4/1976 | Schaeffer et al. | 38/77.3 |
| 4,578,884 | A | * | 4/1986 | Nakao | 38/77.3 |
| 4,646,451 | A | * | 3/1987 | Nakao et al. | 38/77.3 |
| 5,220,738 | A | * | 6/1993 | Baldacci | 38/81 |

* cited by examiner

*Primary Examiner* — Ismael Izaguirre
(74) *Attorney, Agent, or Firm* — Rabin & Berdo, P.C.

(57) ABSTRACT

The present invention discloses an electric iron comprising: at least one base unit a main body provided with a water inlet, a water outlet and a water tank connected between said inlet and said outlet; said base unit and said main body may connected or disconnected by a connecting unit; said base unit provided with a water passage which can connected with said water outlet when in assembly with said main body, a steam outlet, a chamber connected between said water passage and said steam outlet and a heating plate used for heating said chamber. Since the base unit can disconnected to the main body, user can choice different heating plates based on different clothing ironing conditions.

5 Claims, 6 Drawing Sheets

ELECTRIC IRON

TECHNOLOGY FIELD

The invention relates to an electric iron, especially to an electric iron with removable electric heating plate.

BACKGROUND OF THE INVENTION

The electric irons are available in the market, including a shell, an inlet, a steam outlet, a water tank connected between the inlet and the steam outlet, an electromagnetic pump located in the inlet and a heating plate used for heating the water tank, the electromagnetic pump pumping water for the water tank, the heating plate heating the water tank for changing the water in the water tank to steam, the steam ejected through the steam outlet. As the heating plate, the water tank and the electromagnetic pump are set within a shell, and can not be disassemble, so the existence of the following disadvantages: 1, the user can not use different heating plates based on different clothing ironing conditions, this is inconvenient for users, and can not meet consumer's requirement; 2, it is inconvenient for cleaning the heating plates.

SUMMARY OF THE INVENTION

The invention is to provide an electric iron, which overcomes the disadvantage that the user can not use different heating plates based on different clothing ironing conditions.

The present invention adopts the following technical solution:

An electric iron comprising:

A main body provided with a water inlet, a water outlet, and a water tank connected between said water inlet and said water outlet;

A connecting unit, and

At least one base unit, which can be connected or disconnected to the main body by said connecting unit; said base unit provided with a water passage connected with said water outlet when in assembly with said main body, a steam outlet used for ejecting steam and a chamber connected between said water passage and said steam outlet and a heating plate used for heating said chamber.

In the preferred embodiment, the main body further comprising: a first shell, the water tank is disposed in said first shell, said water outlet is disposed on the bottom surface of the first shell; said base unit further comprising: a second shell, said chamber and said heating plate are disposed in the second shell, said water passage is disposed on the top surface of the second shell.

In the preferred embodiment, said main body provided with a male locking unit, said base unit provided with a female locking unit, a connecting unit, which is locking and unlocking, formed between the male locking unit and the female locking unit.

In the preferred embodiment, a concave portion formed in the bottom surface of the first shell, said outlet is set on the concave portion; a convex portion formed in the top surface of the second shell, said water passage is set on the convex portion, said concave portion matches said convex portion.

In the preferred embodiment, the main body further comprising: a power cord and a first electric interface electrically connected to said power cord; the base unit further comprising a second electric interface electrically connected with said first electric interface in assembly, said second electric interface electrically connected with heating plate.

In the preferred embodiment, said first electric interface is set on the bottom surface of the first shell, said second electric interface is set on the top surface of the second shell.

In the preferred embodiment, the main body further comprising a control unit, said control unit electrically connected with the power cord and the first electric interface.

In the preferred embodiment, the main body further comprising a pump electrically connected with the control unit and connected with the water inlet of the water tank.

In the preferred embodiment, at least two base units, furthermore, heating plates of each base unit are provided with different power.

Compared with the prior art, because the base unit can disconnected to the main body, user can choice different heating plates based on different clothing ironing conditions. Because said water outlet of the main body is provided on the bottom surface of the first shell, said water passage of the base unit is provided on the top surface of the second shell, when is assembling the base unit and the main body, the outlet is connected with the water passage, this prevent water leakage. A connecting unit, which is locking and unlocking, formed between the male locking unit and the female locking unit, when the connecting unit is locking, the base unit can not be detached from the main body. The power cord is set in the main body, this is convenient for design the pump and the control key. Since the first electric interface is set in the bottom surface of the first shell, said second electric interface is set in the top surface of the second shell, this guarantees that the heating plate is electrically connected with the control unit, when the outlet is connected with the water passage.

BRIEF DESCRIPTION OF THE DRAWINGS

The present invention will be further explained with the drawings and the embodiments.

DESCRIPTION OF THE PREFERRED EMBODIMENTS

Figure 1:
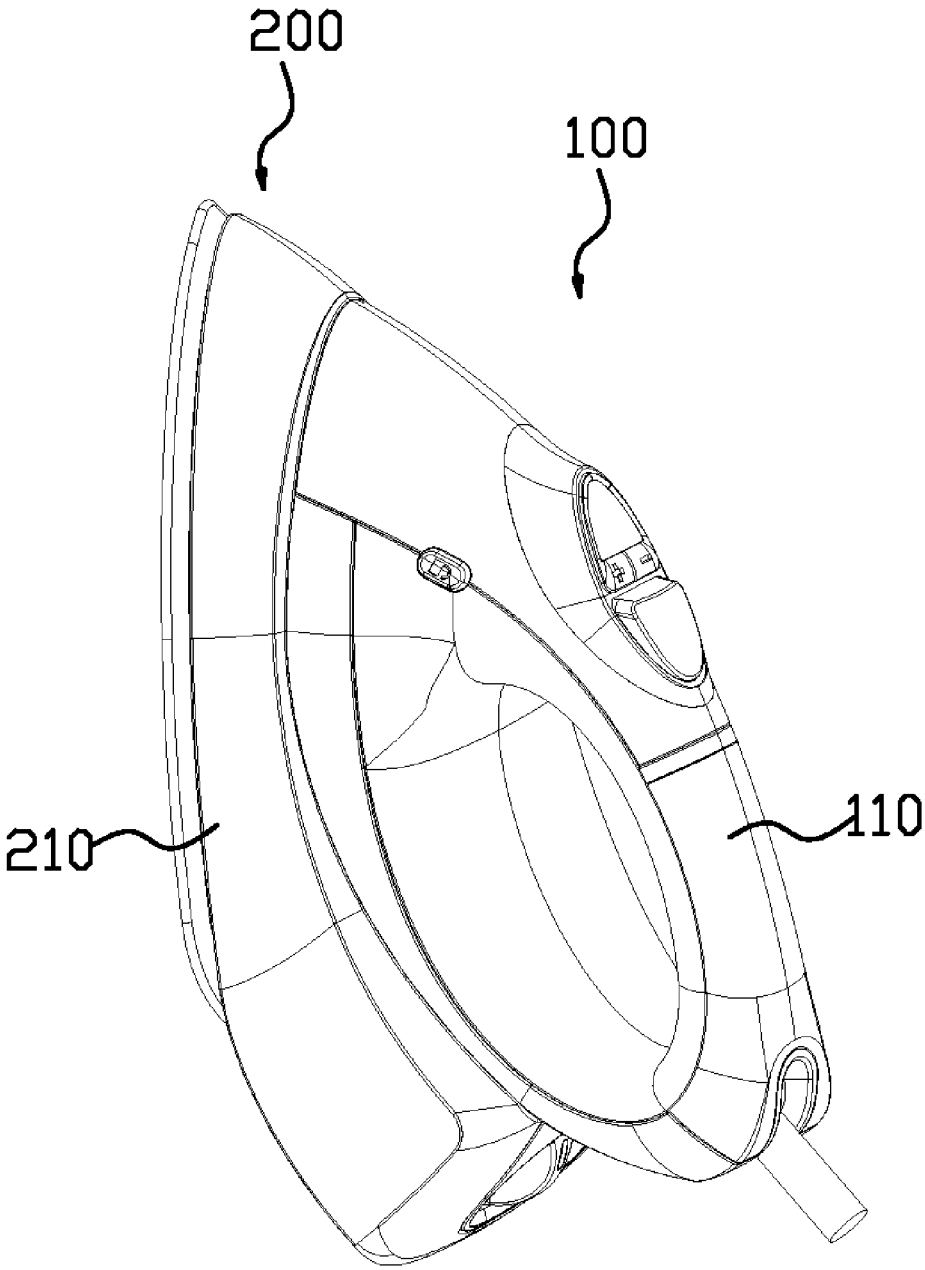
FIG. 1 is a perspective view of the preferred embodiment of the electric iron.
Figure 2:
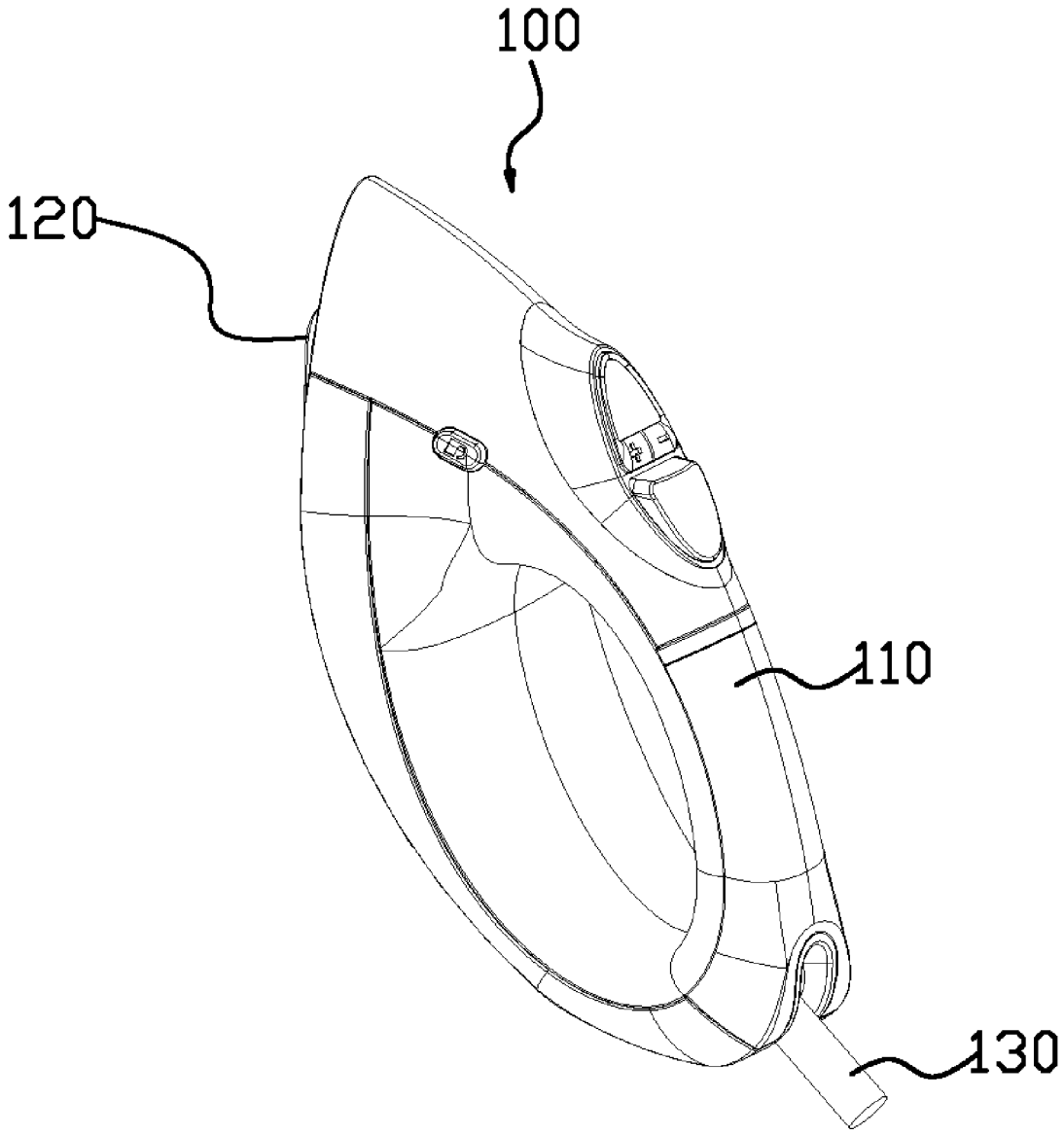
FIG. 2 is a perspective view of the main body of the preferred embodiment.
Figure 3:
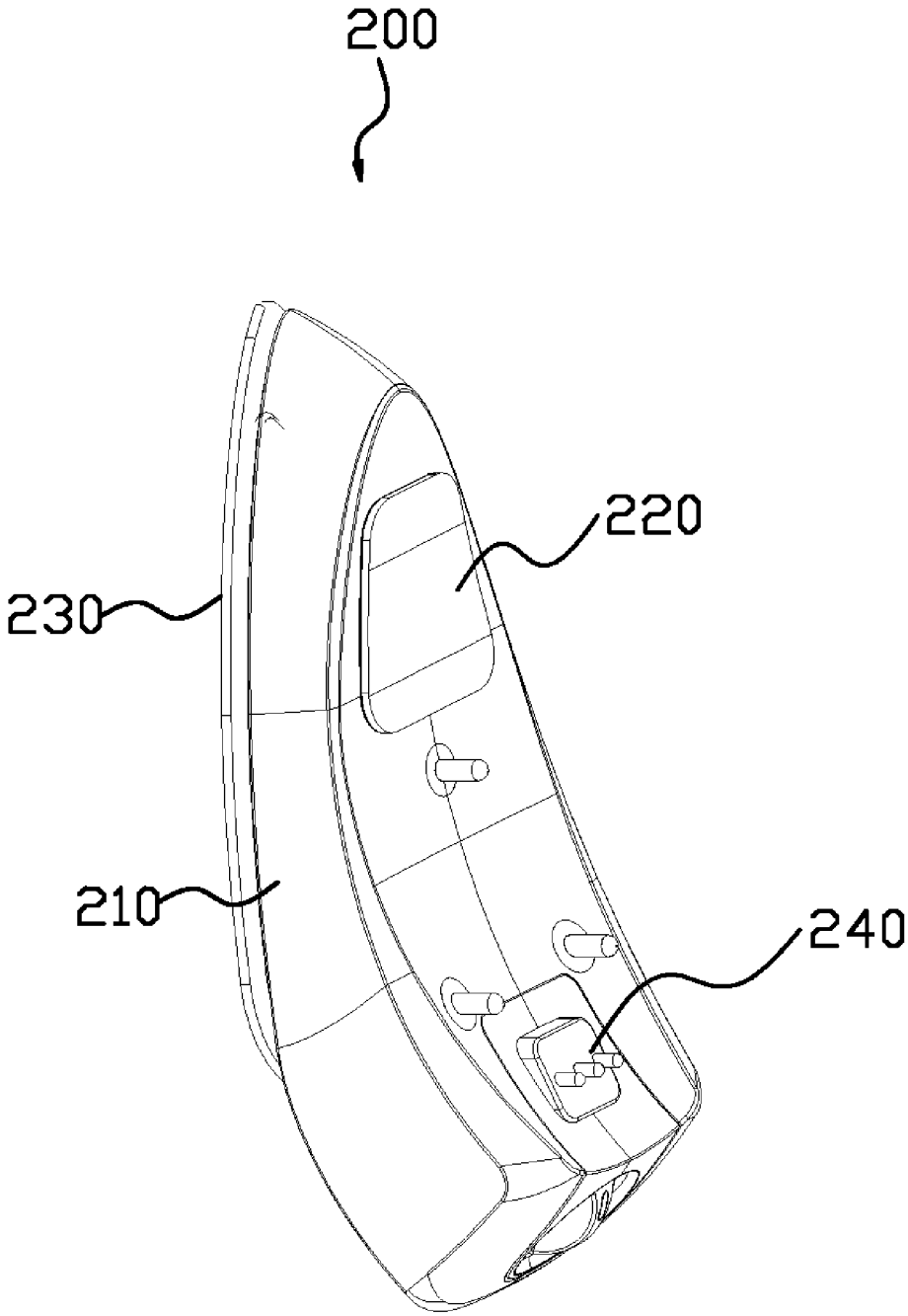
FIG. 3 is a perspective view of the base unit of the preferred embodiment.
Figure 4:
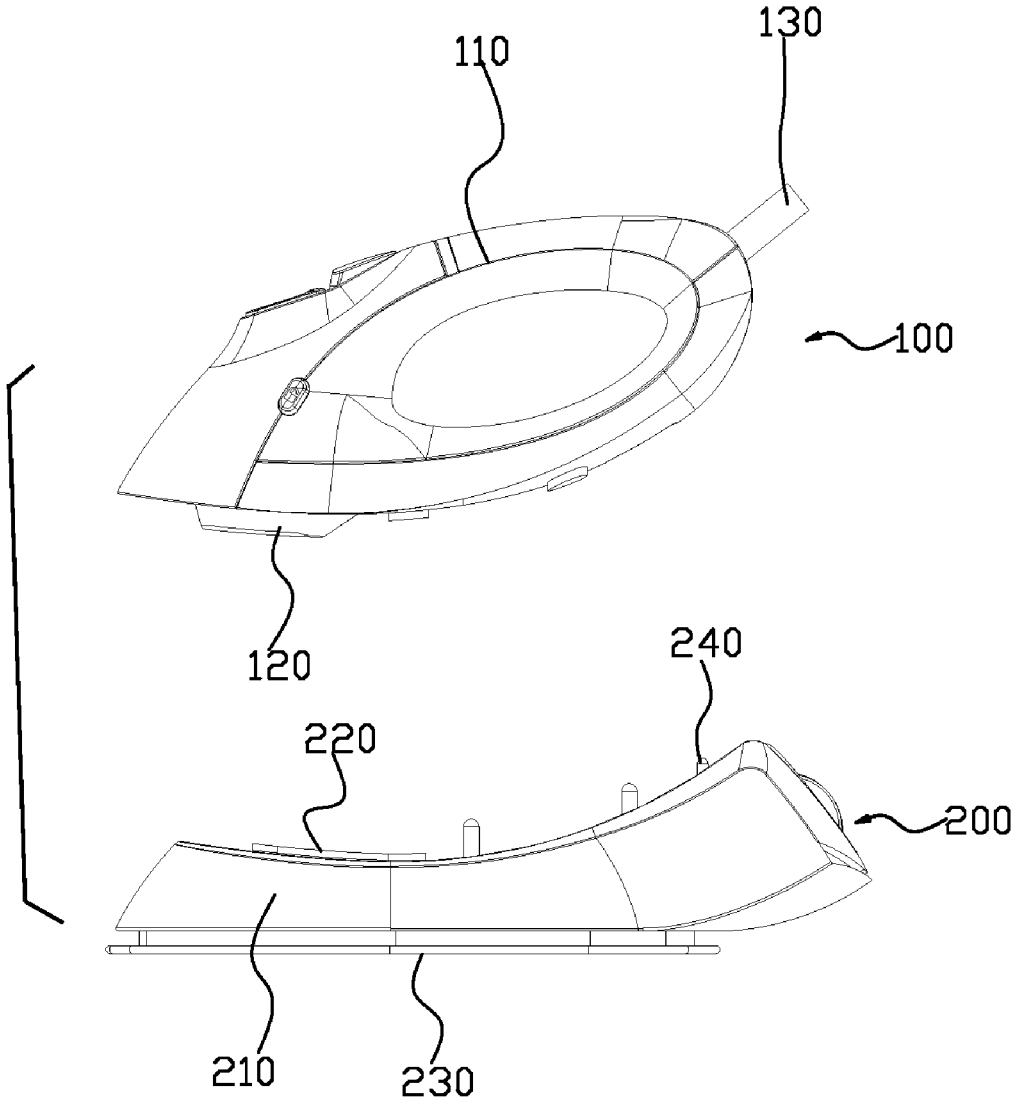
FIG. 4 is a perspective view of the electric iron in separating state.

Referring to FIGS. 1,2,3,4, an electric iron includes a main body 100 and at least two base units 200. The structure of the base units is the same, but the types (power) are different.

Figure 5:
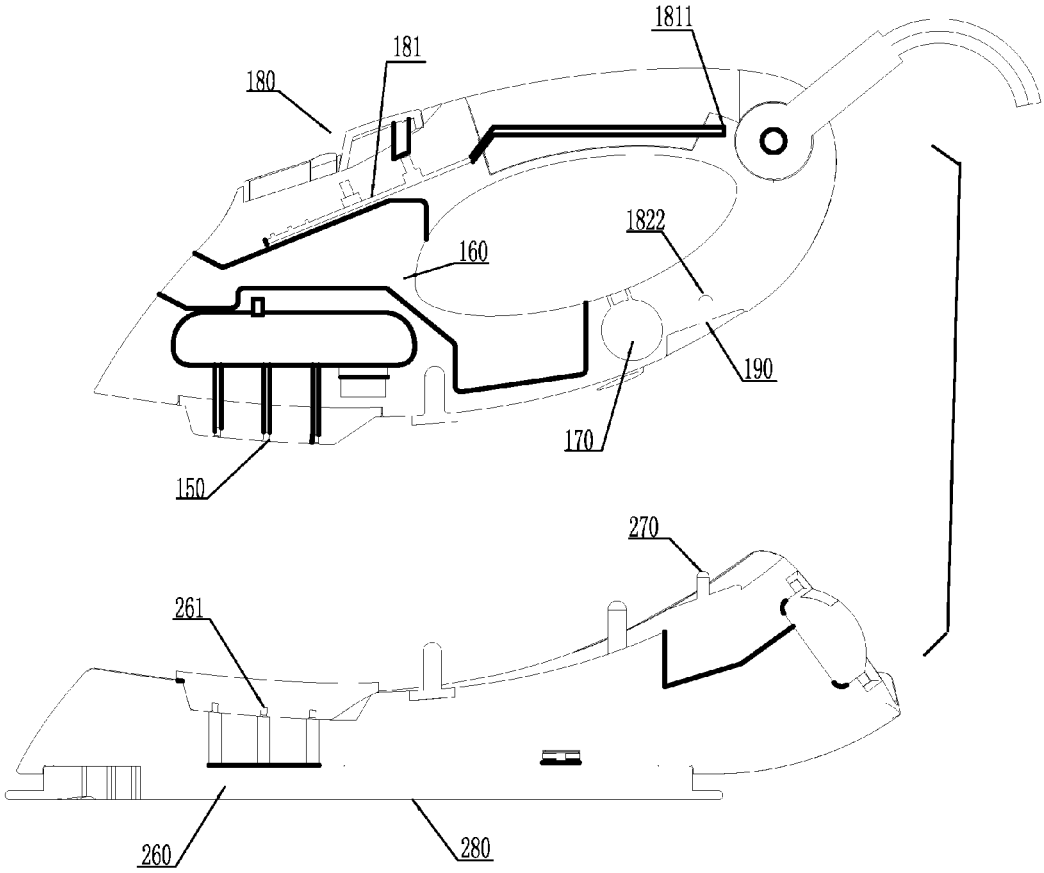
FIG. 5 is a sectional view of the FIG. 4.
Figure 6:
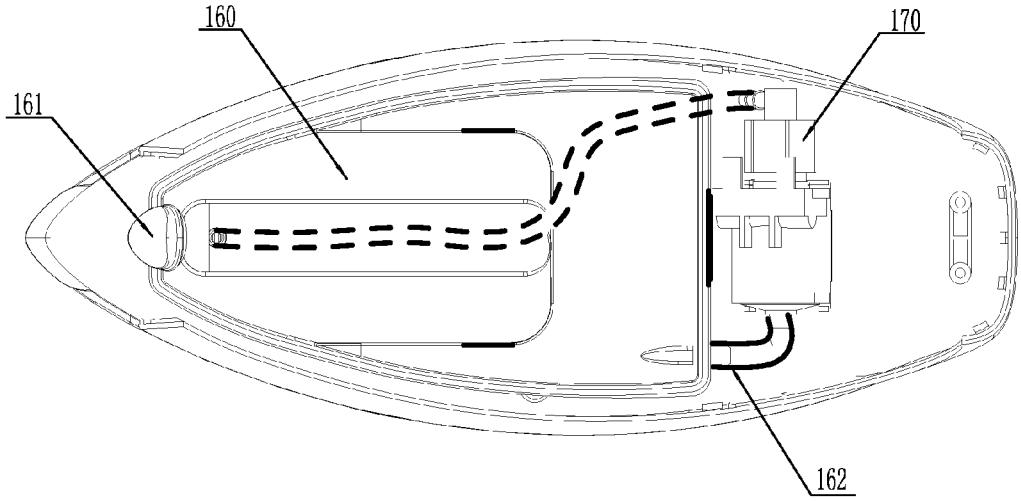
FIG. 6 is a sectional view of the main body.

Referring to FIGS. 1, 2, and 4-6, the main body 100 is provided with a first shell 110, a water inlet 140, a water outlet 150, a water tank 160 connected between said water inlet 140 and the said water outlet 150, an electromagnetic pump 170 connected to said water inlet 140, a control unit 180, a first electric interface 190 and a power cord 130. The water tank 160, said electromagnetic pump 170, said control unit 180 are set in the first shell 110. A handle is formed on the first shell 110 for gripping by a user.

Said water tank 160 is provided with an inlet 161 and an outlet 162. Said inlet 161 is connected with the inlet 140 of the main body. The inlet 140 of the main body is connected with electromagnetic pump 170, and used for pumping water into the water tank 160. Said outlet 162 is connected with the outlet 150 of the main body, and used for discharging water.

The outlet of the main body is set in the convex portion 120 of the bottom surface of the first shell 110.

Said control unit 180 is provided with an input terminal 1811, two output terminals 1822 and a control panel 181. Said input terminal is electrically connected to the power cord 130, said power cord 130 is orientated in the first shell 110, and goes through the first shell 110 so as to connect the control unit with a power supply. Said two output terminals 1822 are respectively electrically connected with the electromagnetic pump 170 and the first electric interface 190. Said first electric interface 190 is set in the concave portion of the bottom surface of the first shell 110. The first electric interface 190 is a current-conducting plate 1911. The current-conducting plate 1911 is provided with three current-conducting bores 191. Said control panel 181 is set on the top of the first shell 110, for control by user.

Referring to FIGS. 1 and 3-6, said base unit 200 is provided with a second shell 210, a water passage 260 connected with said outlet of the main body when assembled, and a steam outlet 230 used for ejecting steam. The water passage 260 of the base unit connected to said steam outlet 230 and a second electric interface 270, and a heating plate used for heating said water passage 260. Said water passage 260 and said heating plate are position in the second shell 210.

Said water passage 260 has an inlet 261 and an outlet 262. Said inlet is connected with the inlet of the base unit for receiving water. The inlet is set in the concave portion 220 of the top of the second shell 210. The concave portion 220 mates the convex portion 120 of the main body 100. Said outlet is set in the bottom surface of the second shell 220 and is connected with steam outlet 230 for ejecting steam.

Said heating plate 280 is electrically connected with the second electric interface 270. Said second electric interface 270 is set the convex portion 240 of the top surface of the second shell 210. The convex portion 240 mates the concave portion of the main body 100. The second electric interface 270 is a current-conducting pole. The current-conducting pole inserts to the current-conducting bore of the first electric interface. The temperature of said heating plate can be controlled by thermostat or thermistor.

The bottom surface of the main body 100 mates the top surface of base unit 200. A connecting unit, which is locking and unlocking, is formed between the first shell 110 and the second shell 210, i.e., a connecting unit, which is for locking and unlocking, is formed between the main body 100 and the base unit 200, which includes a male locking unit provided on the main body and the female locking unit provided on the base unit. Said connecting unit can be a clasp, or hook. Since the connecting unit is existing technology, it will not be further explained.

If required, an orientation mechanism is provided between the first shell 110 and the second shell 210. The orientation mechanism can be a orientation rod and a corresponding orientation bore. The orientation bore is set on one shell, and the orientation rod is set on the other shell.

In use, said main body 100 is positioned above the base unit 200, the connecting unit is locking, the concave portion mates the convex portion, this leads that: the outlet of main body is connected with the water passage of the base unit, the water that comes from the outlet of main body goes through the water passage of the base unit and into the water passage, the current-conducting pole inserts to the current-conducting bore, said first electric interface is electrically connected to said second electric interface, the control unit provides the power for the heating plate via the first electric interface and the second electric interface. User can use different heating plates based on different clothing ironing conditions to achieve the best ironing effect.

As mentioned above, the described embodiments are to be considered in all respects only as illustrative and no restrictive. All changes which come within the meaning and range of equivalency of the claims are to be embraced with their scope.

What is claimed is:

1. An electric iron, comprising:

a main body provided with a first shell, a water inlet, a water outlet disposed on a bottom surface of said first shell, a water tank disposed in said first shell and being connected between said water inlet and said water outlet, a power cord, a first electric interface set on the bottom surface of said first shell and being electrically connected to said power cord, a control unit electrically connected with said power cord and said first electric interface, and a pump electrically connected with said control unit and being connected with said water inlet;

a connecting unit; and at least one base unit provided with a second shell, a second electric interface set on a top surface of said second shell and being electrically connected with said first electric interface when said base unit is assembled with said main body, a water passage disposed on the top surface of said second shell and being connected with said water outlet when said base unit is assembled with said main body, a steam outlet, a chamber connected between said water passage and said steam outlet, and a heating plate electrically connected with said second electric interface, said chamber and said heating plate being disposed in said second shell.

2. The electric iron according to claim 1, wherein said connecting unit comprises a male locking unit disposed on said main body and a female locking unit disposed on said base unit.

3. The electric iron according to claim 1, wherein a concave portion is formed in the bottom surface of the first shell and said water outlet is set on the concave portion; a convex portion is formed in the top surface of the second shell and said water passage is set on the convex portion; said concave portion matching said convex portion.

4. The electric iron according to claim 1, wherein said at least one base unit includes a further base unit, with heating plates of each base unit being provided with different power.

5. The electric iron according to claim 1, wherein said base unit is removably attached to said main body and locked and unlocked thereto using said connecting unit.

* * * * *